US007615716B2

(12) United States Patent
William

(10) Patent No.: US 7,615,716 B2
(45) Date of Patent: Nov. 10, 2009

(54) POSITION RESPONSIVE SWITCH

(76) Inventor: Manson William, 280 Prairie Ave., Calumut City, IL (US) 60409

( * ) Notice: Subject to any disclaimer, the term of this patent is extended or adjusted under 35 U.S.C. 154(b) by 9 days.

(21) Appl. No.: 11/828,689

(22) Filed: Jul. 26, 2007

(65) Prior Publication Data

US 2009/0026060 A1 Jan. 29, 2009

(51) Int. Cl.
*H01H 35/18* (2006.01)

(52) U.S. Cl. ..... 200/84 R

(58) Field of Classification Search ..... 200/84 R, 200/61.45 R, 61.52, 220, 193, 229, 52 R, 200/215

See application file for complete search history.

(56) References Cited

U.S. PATENT DOCUMENTS 3,934,103 A 1/1976 Walstra
4,282,412 A * 8/1981 Florin ..... 200/52 R
4,434,337 A * 2/1984 Becker ..... 200/220
5,208,430 A 5/1993 Ludzia
5,457,293 A 10/1995 Breed
5,530,428 A 6/1996 Woods
5,543,767 A 8/1996 Elenbaas
7,446,272 B2 * 11/2008 Chou ..... 200/61.45 R
2003/0016106 A1 1/2003 Woods

* cited by examiner

*Primary Examiner*—Edwin A. Leon
(74) *Attorney, Agent, or Firm*—Advantia Law Group; Michael W. Starkweather; Jason P. Webb

(57) ABSTRACT

A position responsive switch. A position responsive switch comprises of a two chamber housing having a first and a second chamber. An aperture is disposed between the two chambers. A first lead wire and a second lead wire extend through the second chamber. A first and second set of contact members are coupled to the first lead wire and second lead wire. A conductive object is disposed within the two chamber housing. The conductive object is disposed in the second chamber and couples a contact member from the first set and second set together to form an electrical communication therewith. The first set of contact members and the second set of contact members are splayed upon and substantially conforming to the contour of an interior surface of the second chamber; and alternate in configuration around the chamber. An airtight container is configured to enclose the two chamber housing.

18 Claims, 8 Drawing Sheets

POSITION RESPONSIVE SWITCH

BACKGROUND OF THE INVENTION

1. Field of the Invention

The present invention relates to a contact switch, specifically to a position responsive switch for a water pump.

2. Description of the Related Art

Position sensitive switches have been utilized to turn on and off a light upon the opening and closing of the electrical circuit state. A quantity of mercury was usually used as the movable conductor; the mercury is gravity responsive and reacts to either completing or disconnecting the circuit state. However, mercury is now considered a hazardous material and the use should be avoided, due to the environmental and health concerns. The use of position sensitive switches has many different applications; this application refers to liquid level sensing switches. Liquid level sensing switches are important to know that a proper liquid level is being maintained. If the liquid level is not maintained usually, the liquid level sensing switch will turn on a pump to extract the necessary level of liquid to return the liquid level to a normal state. Nevertheless, liquid level sensing switches have been limited in application due to the relative size of the switch, the expense of the switch, and the switch reliability. Some improvements have been made in the field. Examples of references related to the present invention are described below, and the supported teachings of each reference are incorporated by reference herein:

U.S. Pat. No. 5,208,430, issued to Ludzia, discloses a position responsive switch having a ball received within a hollow cylindrical conductor. Depended upon the position of the switch, the ball may contact only the hollow cylindrical conductor or it may also contact a second conductor to complete a circuit between the two conductors. The cylindrical conductor and ball are enclosed in a two-part insulating housing, including a hollow member having one closed end, and a cap for closing the open end of the hollow member. Electrical leads are connected to the two conductors through the closed end of the hollow housing member.

U.S. Pat. No. 3,934,103, issued to Walstra, discloses a liquid level sensing switch that has an open ended chamber in an electrically conductive body, has an insulating bushing disposed in the open end of the body chamber and has a contact member extending through the bushing to dispose one end of the contact member in spaced relation to the body at the closed end of the body chamber. An electrically conductive magnetizable ball is disposed in the chamber for movement between a closed circuit position engaging both the body and the contact member and an open circuit position spaced from one of these components. A float is mounted on the body exteriorly of the chamber and carries a magnet so that movement of the float between two positions outside the body in response to change in liquid level is effective to move the ball between open and closed circuit positions within the body chamber.

U.S. Pat. No. 5,543,767, issued to Elenbaas, discloses an electrical switch functioning as a tilt, proximity or relay switch that includes an elongate cylindrical housing with a first open end and a second closed end. A flexible spring extends longitudinally in the housing and is supported away from the housing by a seal at the open end. The housing and spring are electrically conductive and an electrically-conductive spherical ball is located within the housing for selective rolling engagement with the spring and housing. The switch functions as a single pole single throw type switch. A second spring can be located at the closed second end of the housing and supported similar to the first spring. By locating the spherical ball between the two springs, a single pole double throw switch is formed.

U.S. Pat. No. 5,530,428, issued to Woods, discloses a magnetic switch assembly that is provided for detecting relative movement between first and second adjacent members, and to defeat attempted magnetic manipulation of the assembly. The assembly includes a pair of adjacent, superposed, upper and lower switch elements adapted for mounting on the first member, with the lower switch element presenting a sloped surface. A shiftable, ferromagnetic ball is disposed between the elements and movable along surface between spaced upper and lower switch operating positions. A magnet adapted for mounting on the second member is also provided, and is oriented for normally retaining the ball in the upper position thereof; however, upon movement of the member, the ball is permitted to shift downwardly along the sloped surface to the lower switch operating position thereof. Attempted magnetic manipulation via external magnet also causes the ball to shift from the upper to the lower position thereof. The respective switch assemblies are capable defeating attempted external magnetic manipulation as ball traverses transversely oriented elongated paths of travel responsive to external magnetic forces.

U.S. Pat. No. 5,457,293, issued to Breed, discloses a unique geometry that is used to amplify the force created by gravity on a tilting mass to substantially increase the resulting contact force in a mechanical tilt switch. In some cases a novel contact surface containing abrasive particles is also used to substantially reduce the contact force required to achieve a low contact resistance. The combination of these two features permits a substantial reduction in the size of the seismic mass needed for mechanical tilt switches and results in a switch which has a comparable size and comparable performance to mercury switches without the use of mercury. In some applications the effect of vibration is reduced by partially filling the switch housing with a damping fluid.

U.S. Patent Application Publication No.: 2003/0016106, by Woods, discloses an improved magnetic switch that is provided which is designed for use in an alarm circuit in order to detect relative movement between first and second members such as a door and frame, so as to signal unauthorized opening of the door. The switch includes a switch assembly for mounting in frame and having first and second switch elements, a permanently magnetized, shiftable body adjacent the elements, and a first attractive component. Additionally, the switch has a second attractive component for mounting to the door, which is in the form of a ferromagnetic component such as a permanent magnet or steel plate. In use when door is closed and circuit is armed, the magnetic attraction between body and component shifts the body to a switch-closed position in simultaneous contact with the switch elements. If the door is opened, the magnetic attraction between body and component moves the body to a switch-open position out of simultaneous contact with the switch elements, thus triggering circuit. If an intruder attempts to defeat the switch through an external magnet, this again moves the body to a switch-open position, triggering the circuit.

The inventions heretofore known suffer from a number of disadvantages which include being expensive, being non-durable, being not long lasting, and being unreliable.

What is needed is a steel ball contact switch that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available steel ball contact switch. Accordingly, the present invention has been developed to provide an efficient and long lasting position responsive switch.

A position responsive switch that may include a two chamber housing having a first chamber and a second chamber. An aperture may be configured between the first chamber and the second chamber, to allow for a passage between the first and second chambers. A first lead and a second lead wire may extend through the second chamber, wherein the first lead wire is not in electrical communication with the second lead wire. A first set of contact members may be coupled to the first lead wire and in electrical communication therewith. A second set of contact members may be coupled to the second lead wire and in electrical communication therewith. A conductive object may be configured within the two chamber housing, wherein the conductive object is substantially smaller than the first or second chamber. The conductive object may be configured in the second chamber to couple a contact member from the first set of contact members to a contact member from the second set, to form an electrical communication therewith. The contact members couple the first lead wire to the second lead wire, completing an electrical communication.

The first set of contact members and the second set of contact members may be splayed upon and substantially conforming to the contour of an interior surface of the second chamber. The configuration resembles a cage like design, wherein the contact members extend about the interior of the second chamber. The first set of contact members is not in electrical communication with the second set of contact members. The first set of contact members and the second set of contact members may be splayed upon the interior surface of the second chamber, wherein the contact members alternate in configuration upon the contour of the interior surface of the second chamber. The first lead wire and the second lead wire may extend through an insulating member. The first lead wire and the second lead wire may include a twist in the configuration of the wire, through the insulating member. An airtight container may be configured to enclose the two chamber housing. The airtight container may include a securing track to secure the two chamber housing there within. Furthermore, the airtight container is configured with an airtight container cap. Wherein, the first lead wire and the second lead wire may extend through the airtight container cap.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not therefore to be considered to be limiting of its scope, the invention will be described and explained with additional specificity and detail through the use of the accompanying drawing(s), in which.

DETAILED DESCRIPTION OF THE INVENTION

Figure 1:
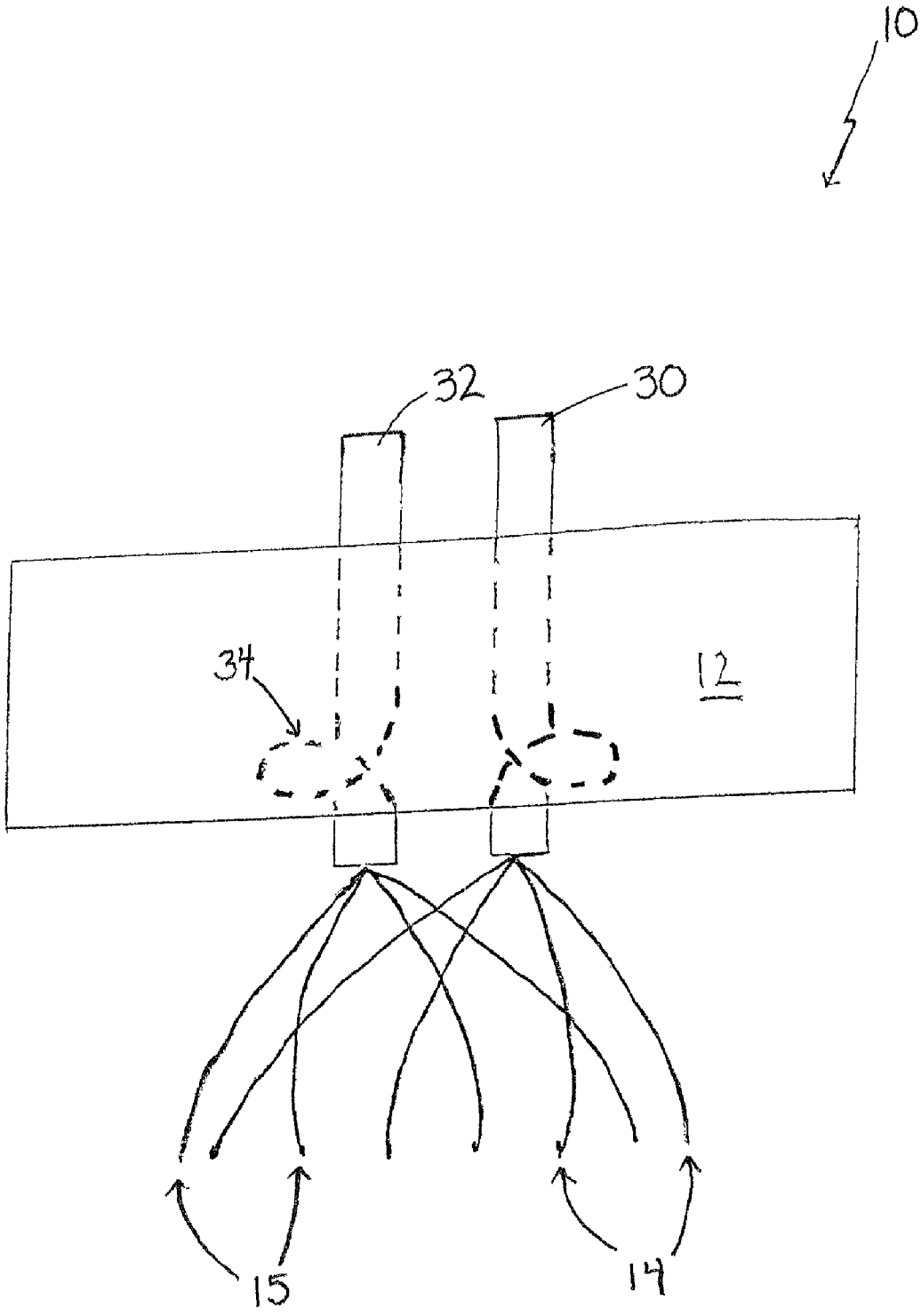
FIG. 1 illustrates a front perspective view of a position responsive switch.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "comprising," "including," "containing," "is, are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Figure 2:
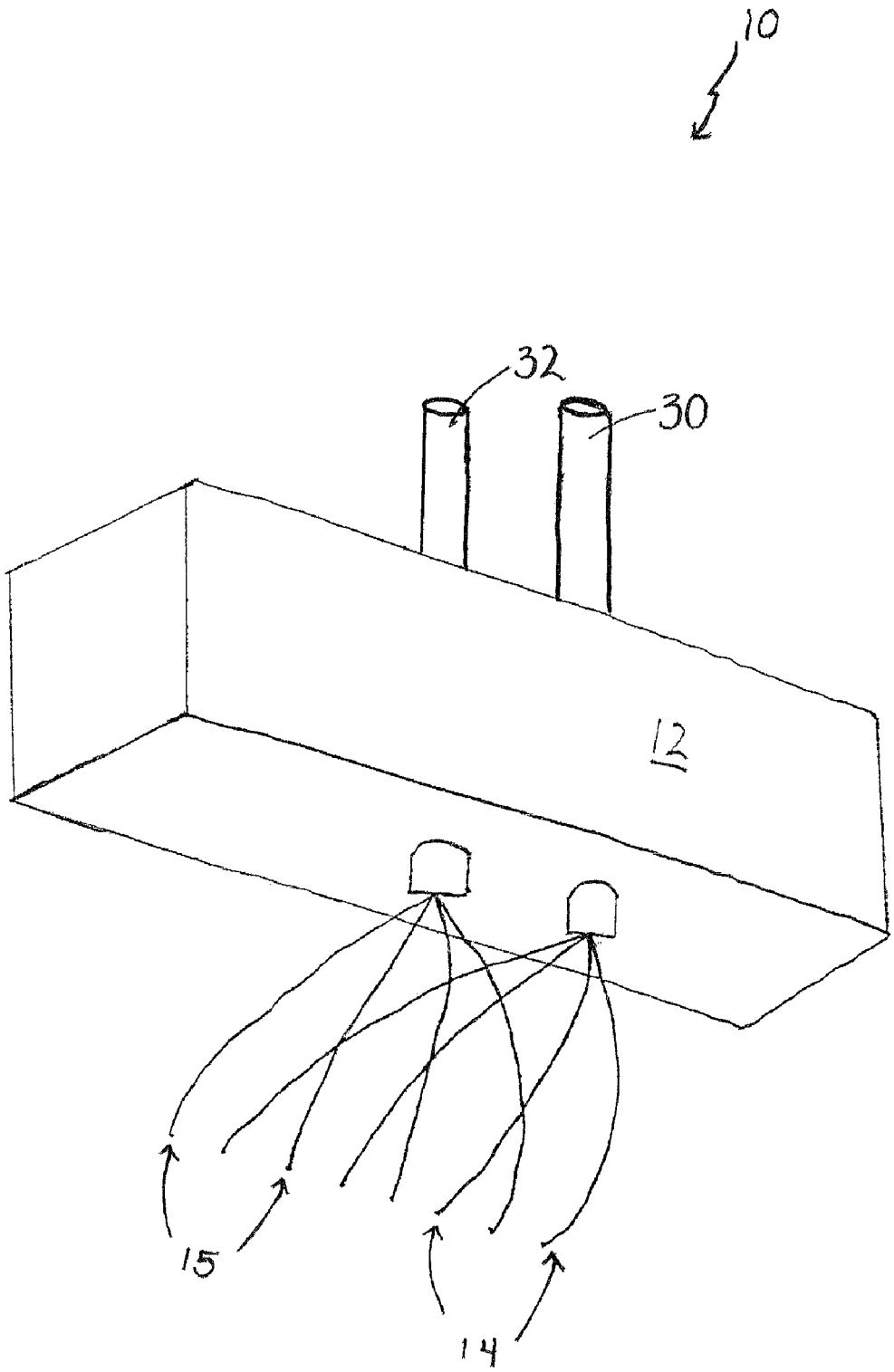
FIG. 2 illustrates a bottom perspective view of a position responsive switch.

FIGS. 1 and 2 illustrate a position responsive switch 10 comprising of a first lead wire 30 and a second lead wire 32 extending through an insulating member 12. In FIG. 1, the first lead wire 30 and the second lead wire 32 include a twist configuration 34. The first lead wire 30 is coupled to a first set of contact members 14. The second lead wire 32 is coupled to a second set of contact members 15. The first lead wire 30 is in electrical communication with the first contact members 14. The second lead wire 32 is in electrical communication with the second contact members 15. One example of a first lead wire 30, second lead wire 32, and contact members 15 may be a copper wire manufactured by Paramount Wire Company, 2-8 Central Avenue, East Orange, N.J. 07018.

Figure 3:
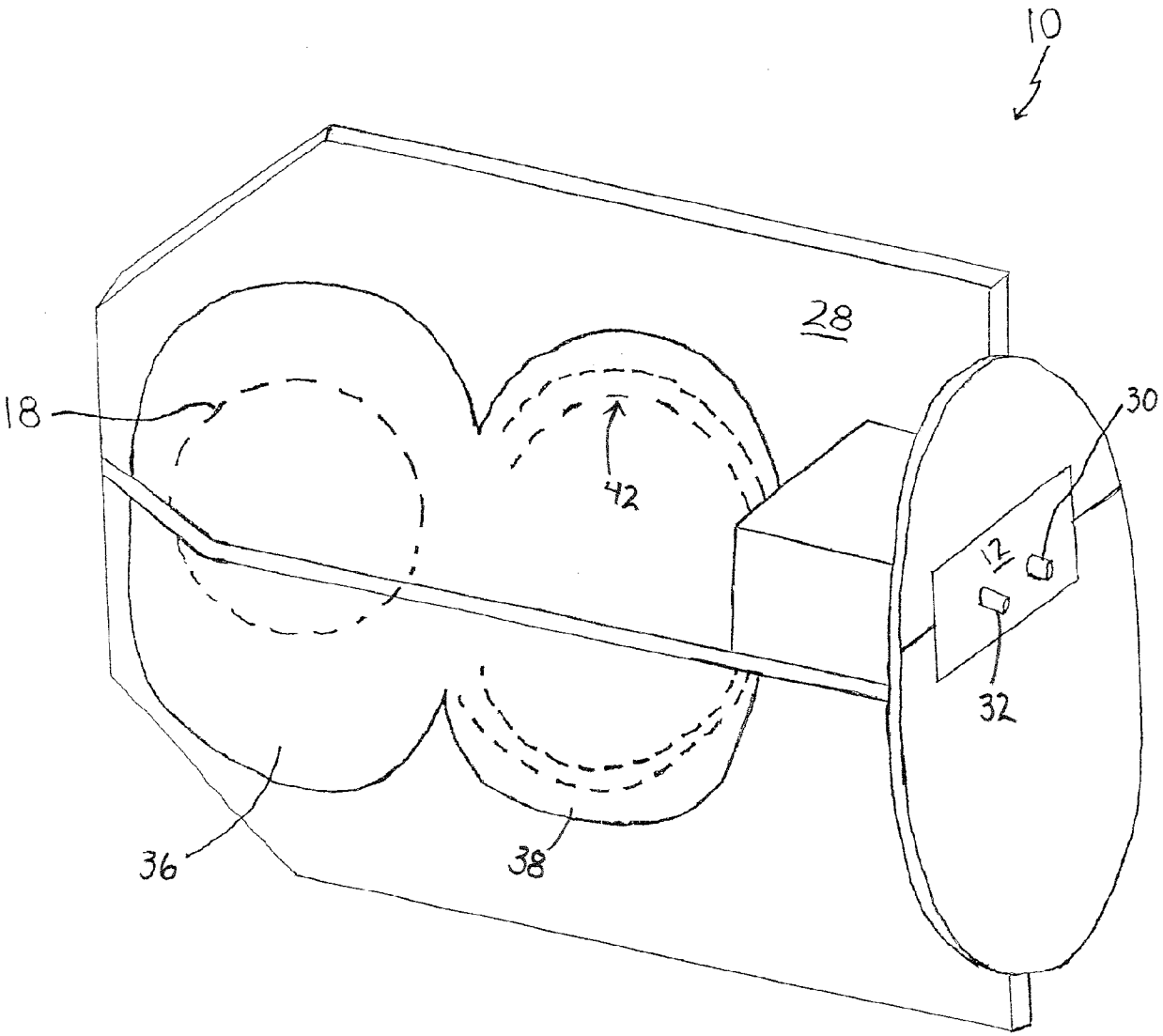
FIG. 3 illustrates a perspective view of a position responsive switch.

FIG. 3 illustrates a position responsive switch 10 comprising of a two chamber housing 28. The two chamber housing 28 includes a first chamber 36 and a second chamber 38, wherein an aperture 40 is disposed between the two chambers 36, 38. The figure illustrates a conductive member 18 disposed in the two chamber housing 28. One example may be but not limited to a conductive member described in U.S. Pat. No. 5,208,430, issued to Ludzia, which is incorporated for its supported teachings herein. The conductive member 18, which may be a stainless steel ball, is configured to be substantially smaller than the first and second chambers 36, 38. The figure further illustrates contact members 14, 15 extending about the interior contour of the second chamber 38 FIG. 3 illustrates a first lead wire 30 and a second lead wire 32 extending through the insulating member 12 and extending to the exterior of the two chamber housing 28.

Figure 4:
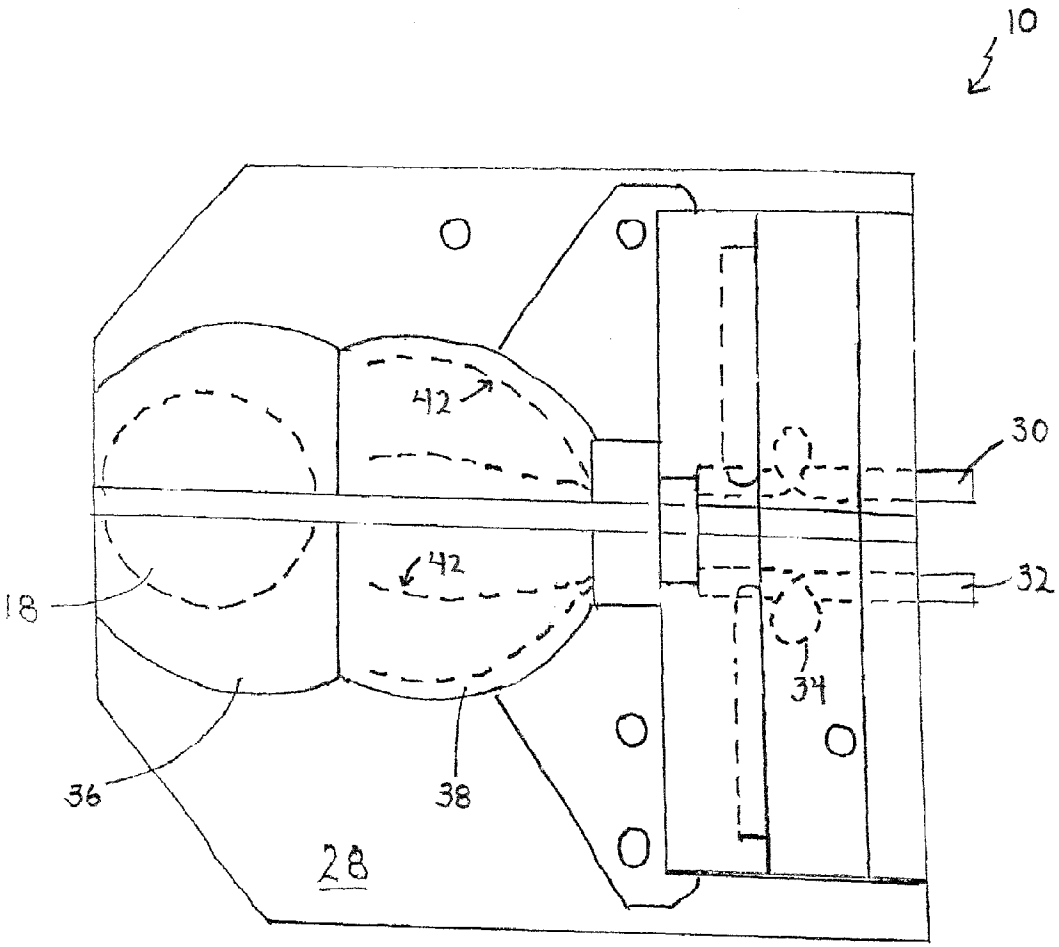
FIG. 4 illustrates a side view of a position responsive switch.
Figure 5:
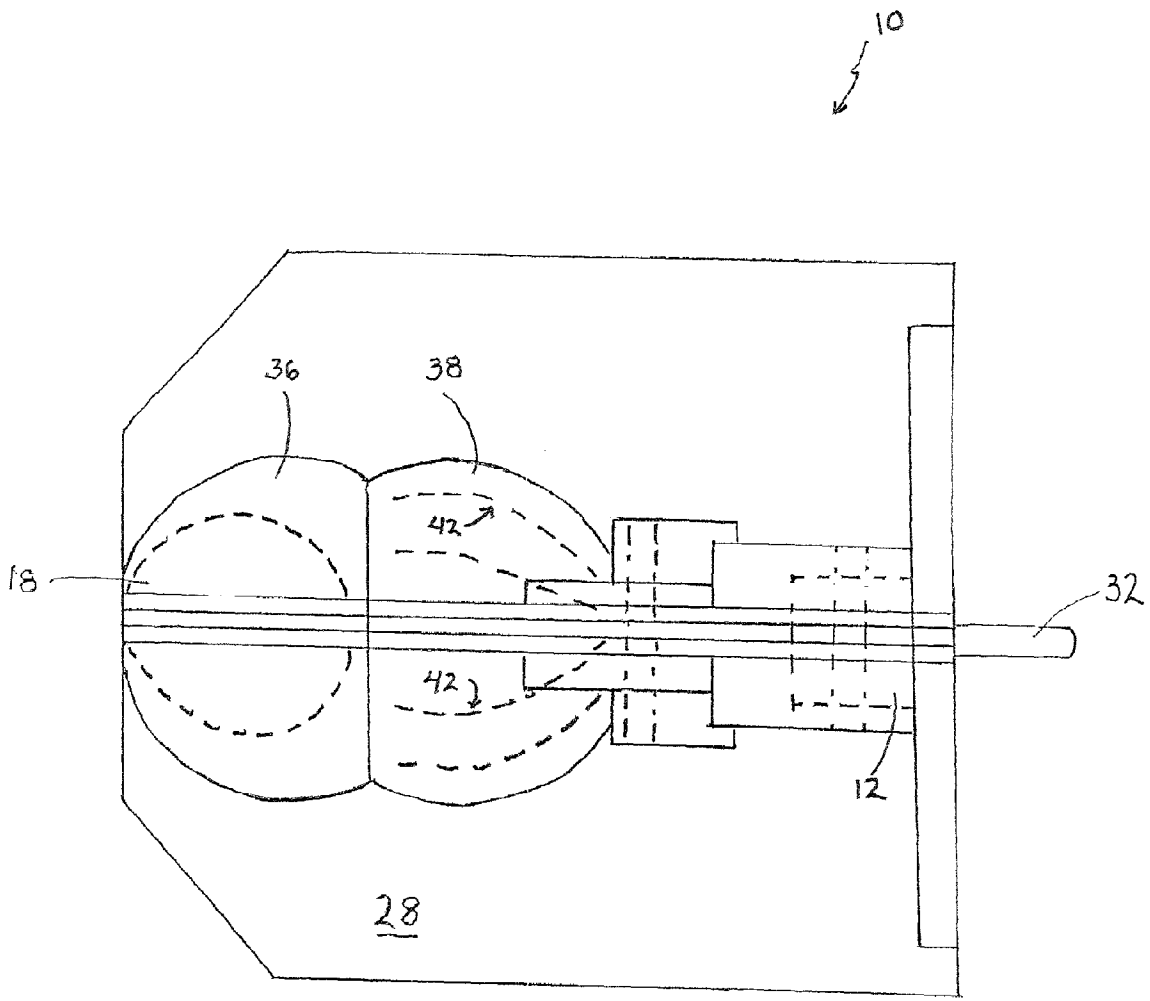
FIG. 5 illustrates a top view of a position responsive switch.

FIGS. 4 and 5 illustrate a position responsive switch 10 comprising of a two chamber housing 28 that includes a first lead wire 30 and second lead wire 32 extending through the two chamber housing 28. The figure illustrates a conductive member 18 disposed within the two chamber housing 28, wherein the conductive member 18 may transition through the aperture 40 from the first chamber 36 to the second chamber 38. The second chamber includes contact members extending along the interior contour of the second chamber. The contact members 14, 15 are coupled to the lead wires 30, 32 and are in electrical communication therewith. FIG. 4 illustrates a twist 34 in the configuration of the first lead wire 30 and second lead wire 32. Furthermore, the figures illustrate the first lead wire 30 and the second lead wire 32 extending through an insulating member 12.

Figure 6:
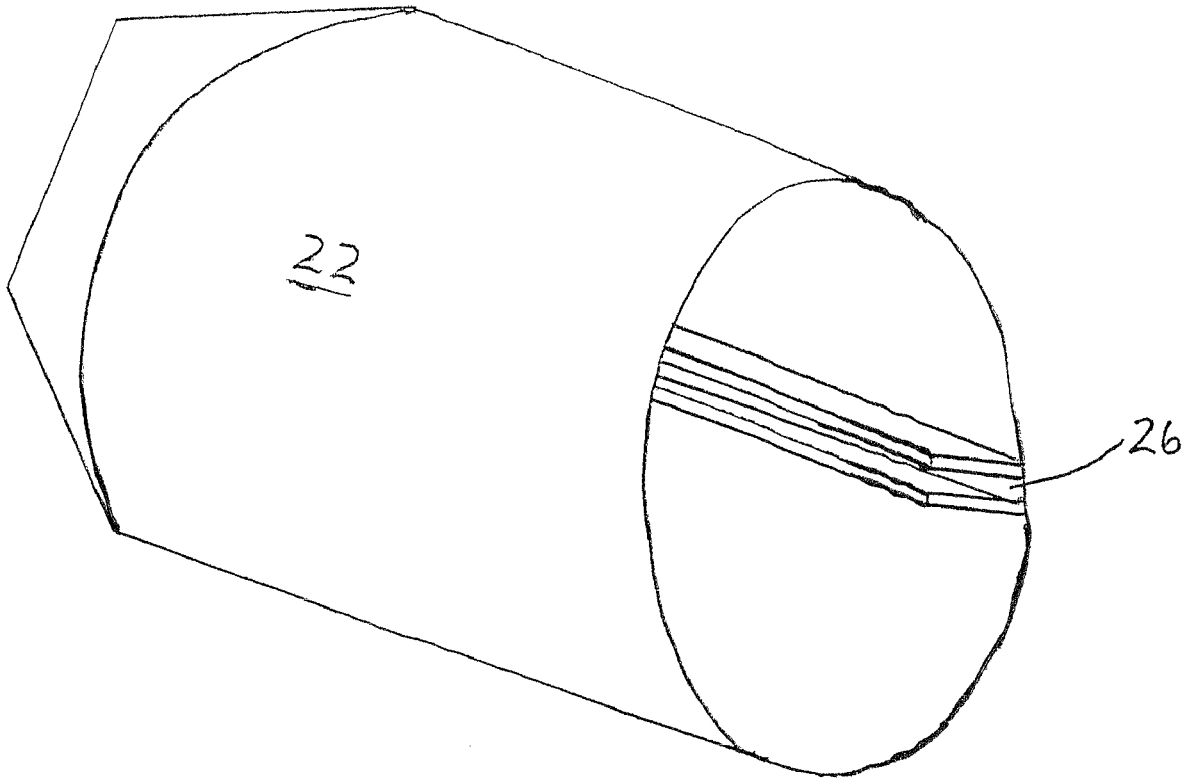
FIG. 6 illustrates an airtight container for a position responsive switch.
Figure 7:
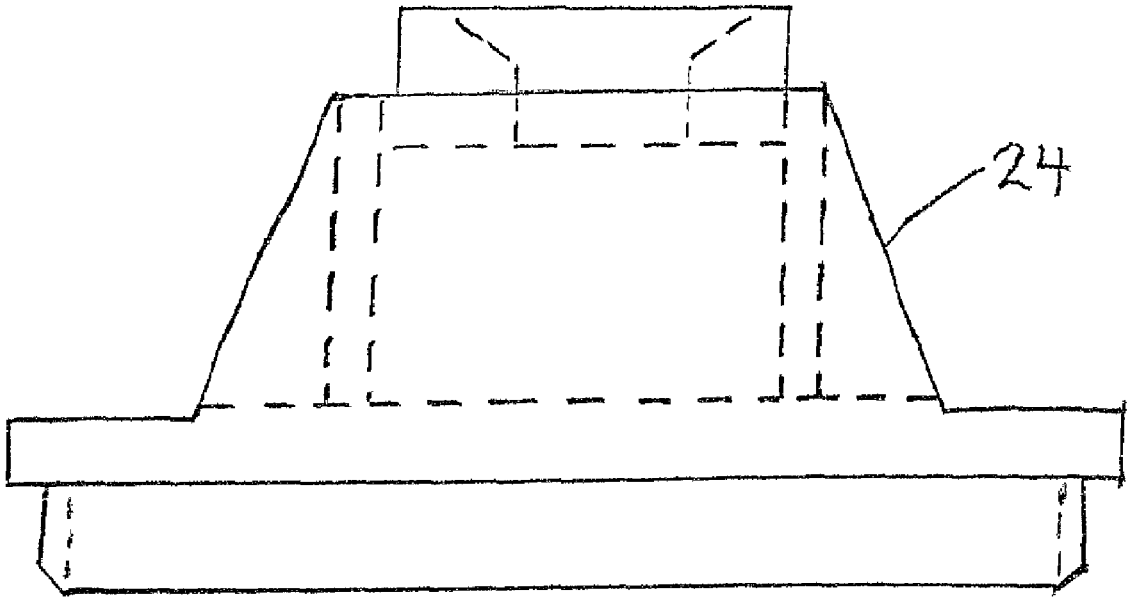
FIG. 7 illustrates an airtight container cap for a position responsive switch.
Figure 8:
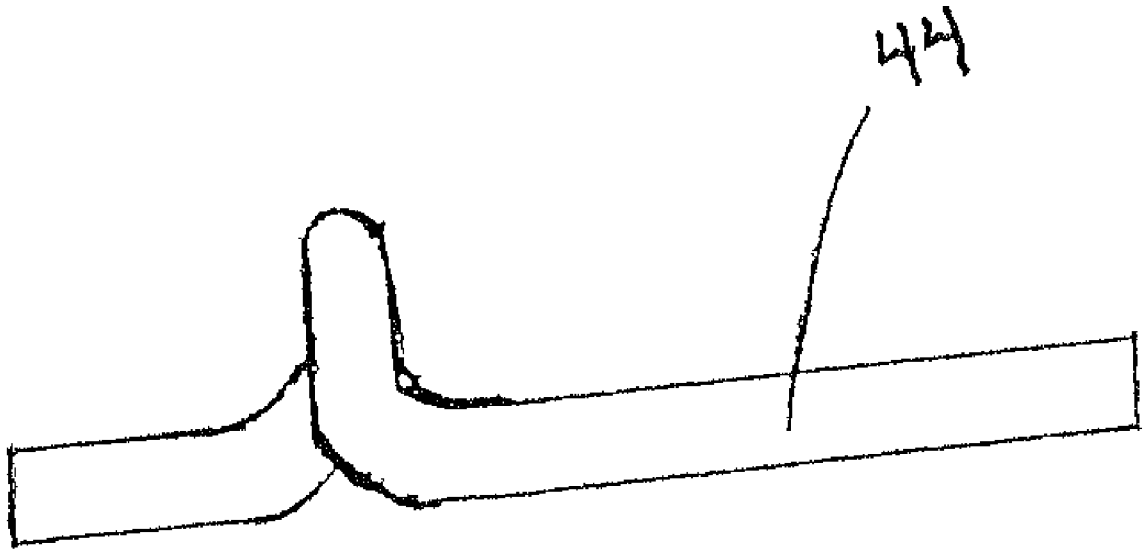
FIG. 8 illustrates a lead wire of the position responsive switch.

FIG. 6 illustrates an airtight container 22 is configured to secure the two chamber housing 28 there within. The airtight container 22 includes a securing member 26 to secure the two chamber housing 28 there within. FIG. 7 illustrates a airtight container cap 24 to seal the two chamber housing 28 in an airtight enclosure. The first lead wire 30 and the second lead wire 32 extend through the airtight cap 24 to provide electrical communication with a water pump. FIG. 8 illustrates the twist configuration 34 of the first lead wire 30 and the second lead wire 32.

In operation of a position responsive switch 10, a user displaces the airtight container 22 of the position responsive switch 10 about water. The position responsive switch 10 floats a top of the water. If the water level decreases or is below an equilibrium level the position responsive switch 10 will remain closed, in an off mode. If the water level increases or is above an equilibrium level, the position responsive switch 10 will shift a conductive member 18 from the first chamber 36 to the second chamber 38. The conductive member 18 will couple to a contact member 14 from the first lead wire 30 and to a contact member 15 from the second lead wire 32. The conductive member 18 completes an electrical communication with the first lead wire 30 to the second lead wire 32, or an open or on mode. The position responsive switch 10 is configured to couple to a water pump to initiate the removal of water until the airtight container 22 is no longer above the equilibrium level.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate spherical chambers, one skilled ion the art would appreciate that the chambers may vary in shape and still perform its intended function. Examples are but not limited to: a circle, a square, an octagon, a hexagon, etc.

Additionally, although the figures illustrate two sets of four contact members, one skilled in the art would appreciate that there may be more or less contact members and still perform its intended function. Examples are but not limited to two contact members, six contact members, eight contact members, etc.

It is also envisioned that conductive member may be made of any conductive material and still perform its intended function. Examples are but not limited to stainless steel, copper, metal, silver, aluminum, etc.

It is expected that there could be numerous variations of the design of this invention. An example is that the two chamber housing and the airtight container may be in one embodiment instead of two separate parts. The two chamber housing may be airtight and buoyant about water as to perform the same function if it were enclosed in an airtight container.

Finally, it is envisioned that the components of the device may be constructed of a variety of materials, the two chamber housing may be comprised of plastic, rubber, rubber composite, metal, metal alloy, etc.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A position responsive switch, comprising:

a) a two chamber housing having a first chamber and a second chamber;

b) an aperture disposed between the first chamber and the second chamber;

c) a first lead wire extending through the second chamber;

d) a second lead wire extending through the second chamber, wherein the first lead wire is not in electrical communication with the second lead wire;

e) a first set of contact members coupled to the first lead wire, and in electrical communication therewith;

f) a second set of contact members coupled to the second lead wire, and in electrical communication therewith; wherein the first set of contact members and the second set of contact members is splayed upon an interior surface of the second chamber, wherein the contact members alternate in configuration around the interior surface of the second chamber;

g) a conductive object disposed within the two chamber housing, wherein the conductive object is substantially smaller than the first or second chamber; and h) the conductive object is disposed in the second chamber to couple at least one contact member from the first set and at least one contact member from the second set together, to enable an electrical communication there between.

2. A position responsive switch as in claim 1, wherein the first set of contact members and the second set of contact members is splayed upon and substantially conforming to the contour of the interior surface of the second chamber.

3. A position responsive switch as in claim 1, wherein the first set of contact members is not in electrical communication with the second set of contact members.

4. A position responsive switch as in claim 1, wherein the first lead wire and the second lead wire may extend through an insulating member.

5. A position responsive switch as in claim 1, wherein the first lead wire and the second lead wire each include a twist in the wire thereof.

6. A position responsive switch as in claim 1, wherein an airtight container is configured to enclose the two chamber housing.

7. A position responsive switch as in claim 1, wherein the first lead wire and the second lead wire extend through the airtight container.

8. A position responsive switch as in claim 1, wherein the airtight container includes a securing track to secure the two chamber housing there within.

9. A position responsive switch as in claim 1, wherein the first chamber is larger than the second chamber.

10. A position responsive switch, comprising:

a) a position responsive switch housing, including:

a1) a first half having two semi-spherical cavities therein;

a2) a second half having two semi-spherical cavities therein and substantially identical to the first half, configured and orientated to mirror the first half;

a3) the first half and the second half include mating members to couple the two halves together;

a4) the first half and the second half couple together to define an aperture between the two spherical cavities;

b) a first lead wire extending through the position responsive switch housing;

c) a second lead wire extending though the position responsive switch, wherein the first lead wire and the second lead wire are not in electrical communication;

d) a first set of contact members coupled to the first lead wire, and in electrical communication therewith;

e) a second set of contact members coupled to the second lead wire, and in electrical communication therewith; wherein the first set of contact members and the second set of contact members is splayed upon an interior surface of a first spherical cavity, wherein the contact members alternate in configuration around the interior surface of the first spherical cavity;

j) a conductive object is disposed within the position responsive switch housing, wherein the conductive object is substantially smaller that the first and second chambers; and k) the conductive object is disposed in the second chamber to couple at least one contact member from the first set and at least one contact member from the second set together, to enable an electrical communication there between.

11. A position responsive switch as in claim 10, wherein the first set of contact members and the second set of contact members is splayed upon and substantially conforming to the contour of the interior surface of the first spherical cavity.

12. A position responsive switch as in claim 10, wherein the first set of contact members is not in electrical communication with the second set of contact members.

13. A position responsive switch as in claim 10, wherein the first lead wire and the second lead wire may extend through an insulating member.

14. A position responsive switch as in claim 10, wherein the first lead wire and the second lead wire each include a twist in the wire thereof.

15. A position responsive switch as in claim 10, wherein an airtight container is configured to enclose the position responsive switch housing.

16. A position responsive switch as in claim 10, wherein the first lead wire and the second lead wire extend through the airtight container.

17. A position responsive switch as in claim 10, wherein the airtight container includes a securing track to secure the position responsive switch housing within the airtight container.

18. A position responsive switch as in claim 10, wherein the first spherical chamber is smaller than the second spherical chamber.

* * * * *

UNITED STATES PATENT AND TRADEMARK OFFICE

CERTIFICATE OF CORRECTION

PATENT NO. : 7,615,716 B2
APPLICATION NO. : 11/828689
DATED : November 10, 2009
INVENTOR(S) : William C. Manson It is certified that error appears in the above-identified patent and that said Letters Patent is hereby corrected as shown below:

Title Pg, Item (76) Inventors:

Delete "Manson William", and insert -- William C. Manson --.

Signed and Sealed this

Fifth Day of January, 2010

David J. Kappos

David J. Kappos
*Director of the United States Patent and Trademark Office*